US007820897B2

(12) United States Patent
Tambara et al.

(10) Patent No.: US 7,820,897 B2
(45) Date of Patent: Oct. 26, 2010

(54) STRING FOR MUSICAL INSTRUMENT AND METHOD FOR MANUFACTURING THE SAME

(75) Inventors: Yoshihiko Tambara, Hamamatsu (JP); Noriyuki Odagi, Hamamatsu (JP)

(73) Assignee: Yamaha Corporation, Shizuoka (JP)

( * ) Notice: Subject to any disclaimer, the term of this patent is extended or adjusted under 35 U.S.C. 154(b) by 48 days.

(21) Appl. No.: 11/728,554

(22) Filed: Mar. 26, 2007

(65) Prior Publication Data

US 2008/0236361 A1 Oct. 2, 2008

(51) Int. Cl.
*G10D 3/00* (2006.01)

(52) U.S. Cl. ..... 84/297 S

(58) Field of Classification Search ..... 84/297 R, 84/297 S, 197, 199

See application file for complete search history.

(56) References Cited

U.S. PATENT DOCUMENTS

| | | | | | |
|---|---|---|---|---|---|
| 3,382,087 | A | * | 5/1968 | Ostrowski | 428/626 |
| 5,578,775 | A | * | 11/1996 | Ito | 84/297 S |
| 6,017,666 | A | * | 1/2000 | Nealey et al. | 430/59.4 |
| 6,248,942 | B1 | | 9/2001 | Hebestreit et al. | |
| 6,787,065 | B1 | | 9/2004 | Schapira et al. | |
| 2005/0241454 | A1 | | 11/2005 | Parker | |
| 2006/0174745 | A1 | | 8/2006 | D'Addario | |

FOREIGN PATENT DOCUMENTS

| | | | | | |
|---|---|---|---|---|---|
| EP | 0700238 | A1 | * | 7/1995 | |
| JP | 22740694 | A | * | 4/1705 | 24/223 |
| JP | 51-90809 | | | 8/1976 | |
| JP | 60067681 | | * | 4/1985 | 84/297 S |
| JP | 2005-148730 | | | 6/2005 | |

* cited by examiner

*Primary Examiner*—Kimberly R Lockett
(74) *Attorney, Agent, or Firm*—William L. Androlia; H. Henry Kdoa

(57) ABSTRACT

A string for a musical instrument of this invention includes a core and a winding wound around the core to have a wound string structure. The winding has a winding body, and a coating film formed on the winding body. The coating film includes a vinyl resin and aminotriazole.

8 Claims, 4 Drawing Sheets

STRING FOR MUSICAL INSTRUMENT AND METHOD FOR MANUFACTURING THE SAME

BACKGROUND OF THE INVENTION

1. Field of the Invention

The present invention relates to a string for a musical instrument and to a method for manufacturing such a string.

2. Description of Related Art

In the prior art, various innovations have been proposed with respect to the strings used with for example guitars and other musical instruments.

Japanese Unexamined Patent Application, First Publication, No. 2005-148730 (JP-A2005-148730) and U.S. Pat. No. 6,248,942, disclose a string for a musical instrument which includes a string body having a core and a winding wrapped repeatedly around the core, and a polymer cover formed by winding on the entirety of the string body a film in which the holes of a porous fluoropolymer material are filled with a low-temperature resin. Further, those documents also disclose a wound string construction in which a core is wrapped by a winding whose surface is covered by a polymer.

The string for a guitar described in Japanese Unexamined Patent Application, First Publication, No. 51-90809 (JP-A S51-90809) is provided with rust-resistant properties by applying a benzotriazole solution to the string body, to form a monomolecular film.

A string for a musical instrument is used under exceedingly harsh conditions. In the case of a guitar string, for example, human fingers come into contact with the string. Consequently sweat adheres to the string, and there is the problem of rusting of the string. Moreover, the string of a musical instrument is required to have a pleasant timbre.

However, the strings for musical instruments described in the above JP-A 2005-148730 and U.S. Pat. No. 6,248,942 have the problem that, compared with ordinary uncoated strings, the timbre is unnatural.

Moreover, the string for a musical instrument described in JP-A S51-90809 has insufficient rust-resistance functions, and so there is the problem that rust occurs due to the sweat and dirt adhering to human hands, as well as to moisture and similar in the air.

SUMMARY OF THE INVENTION

It is, therefore, an object of the present invention to provide a string for a musical instrument which has both satisfactory rust-resistant properties and satisfactory timbre, as well as a method of manufacture of such a string.

In order to resolve the above-mentioned problem, a string for a musical instrument of the present invention has a core and a winding wound or wrapped around the core. The winding has a winding body, and a coating film which includes a vinyl resin and aminotriazole, and is formed on the winding body.

In the string of the present invention, it is preferable that the vinyl resin have a vinyl chloride monitor unit and a vinyl acetate monomer unit.

In the string of the present invention, it is preferable that the vinyl resin further have a maleic acid monomer unit.

In the string of the present invention, it is preferable that the thickness of the coating film be 2 μm or less.

In the string of the present invention, it is preferable that the winding body be formed from copper or from an alloy comprising copper.

A method for manufacturing a string for a musical instrument has the steps of coating a liquid including a vinyl resin and aminotriazole on a winding body, drying the liquid to form the coating film so as to form a winding, and wrapping the winding around a core to form a wound string.

According to the present invention, a string for a musical instrument which can combine both satisfactory rust-resistant properties and satisfactory timbre can be obtained.

DETAILED DESCRIPTION OF THE INVENTION

Figure 1:
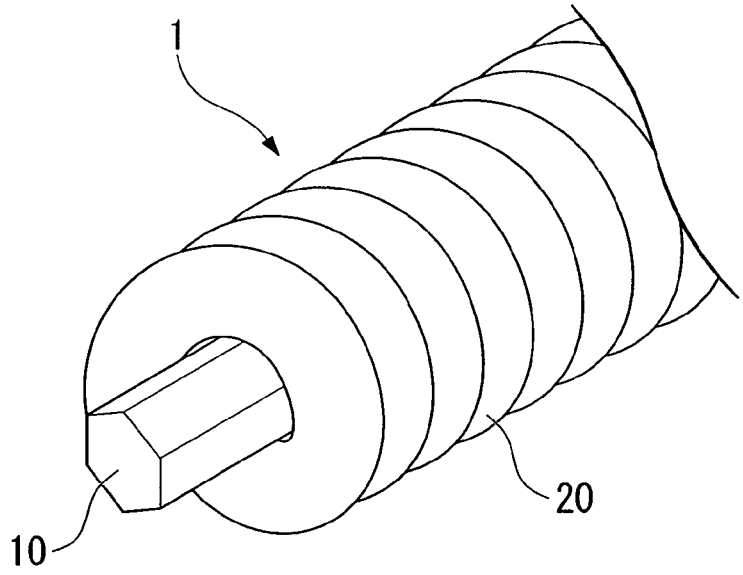
FIG. 1 is a perspective view showing an embodiment of a string for a musical instrument, according to the present invention.
Figure 2:
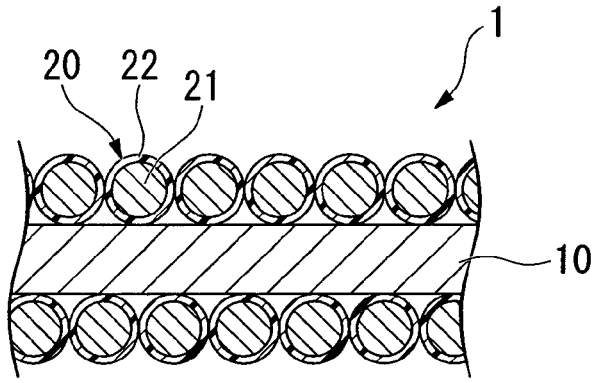
FIG. 2 is a side cross-sectional view showing the string for a musical instrument shown in FIG. 1.

FIG. 1 is a perspective view showing an example of a string for a musical instrument of this invention; FIG. 2 is a side cross-sectional view showing the string for a musical instrument shown in FIG. 1.

Referring to FIG. 1 and FIG. 2, the string 1 for a musical instrument includes a core 10, the cross-section of which is a regular hexagon, and a winding 20, wound and wrapped around the side face of the core 10. The cross-section of the winding 20 is circular. The string 1 thus has a wound string construction which is generally used for guitar bass strings, for instance.

The winding 20 includes a winding body 21, and a coating film 22 formed thereupon as shown in FIG. 2.

In this example, the core 10 is of steel, with diameter 0.42 mm. The winding body 21 is of brass, with diameter 0.47 mm.

As the winding body 21, a wire formed from copper, or from an alloy comprising copper such as brass (an alloy of copper and zinc), results in pronounced advantageous results of the invention, and is suitable.

The coating film 22 is obtained by applying to the winding body 21 a coating liquid formed by dissolving a vinyl resin and aminotriazole in a solvent, and then drying.

In this specification, "vinyl resin" means a polymer of a raw material monomer comprising a monomer with a "$CH_2{=}CH{-}$" group or with a "$CH_2{=}C{=}$" group.

Monomers which have a "$CH_2{=}CH{-}$" group or a "$CH_2{=}C{=}$" group include vinyl chloride, vinyl acetate, styrene, vinylidene chloride, acrylonitrile, acrylic acid, and similar; either one type, or a combination of two or more types, can be used.

Among them, vinyl chloride and vinyl acetate are preferable, and it is more preferable that both be used. That is, a vinyl resin which combines both a vinyl chloride monomer unit and a vinyl acetate monomer unit is preferable. "Vinyl chloride monomer unit" means a monomer unit resulting from cleavage of the ethylene double bond of vinyl chloride. "Vinyl acetate monomer unit" means a monomer unit resulting from cleavage of the ethylene double bond of vinyl acetate.

It is preferable that the mixing ratio of the vinyl chloride monomer unit in the vinyl resin be 95 to 60 weight percent, and more preferably 90 to 75 weight percent. By means of a value equal to or greater than the lower limit, rust-resistant properties are improved. By means of a value equal to or less than the upper limit, the solubility can be adjusted when manufacturing the coating, which is desirable.

It is preferable that the mixing ratio of the vinyl acetate monomer unit in the vinyl resin be 40 to 5 weight percent, and more preferably 25 to 10 weight percent. By means of a value equal to or greater than the lower limit, the solubility of the vinyl resin with respect to the solvent can be improved during manufacture of the coating liquid, which is desirable. By means of a value equal to or less than the upper limit, through combination with other monomer units, rust-resistant properties can be improved, which is desirable.

In addition to the monomer units resulting from cleavage of the ethylene double bond of monomers having a "$CH_2$═CH—" group or a "$CH_2$═C═" group, the vinyl resin may also have other, copolymerizable, monomer units. Among others, copolymerizable, monomer units include monomer units resulting from cleavage of the ethylene double bond of maleic acid and fumaric acid; either one type, or a combination of two or more types, can be used. Among them, in order to improve adhesion with metal, it is preferable that maleic acid monomer units be used. In the vinyl resin, it is preferable that the mixing ratio of the maleic acid monomer unit in the vinyl resin be 5 weight percent or less, and more preferably 2 to 0.5 weight percent.

One type of vinyl resin can be used, or two or more types of vinyl resin can be mixed and used.

It is preferable that the vinyl resin constitute 80 weight percent or more, and more particularly 97 weight percent or more, of the coating film (solid content). By thus using a vinyl resin as the main component of the film, satisfactory rust-resistant properties can be imparted even when the film is thin, so that the advantageous results of the invention are enhanced.

In this specification, "aminotriazole" includes the result of bonding triazole to an amino group, and derivatives thereof. Through the characteristic structure of aminotriazole, having a triazole skeleton and an amino group bonded to the triazole skeleton, excellent rust-resistant properties, and in particular excellent rust-resistant properties when sweat adheres, while vibrating during a performance, while being scraped with a pick, and under other harsh conditions of use, are exhibited.

As "aminotriazole", it is preferable that 3-amino-1,2,4-triazole, and more suitably 3-amino-1H-1,2,4-triazole, and derivatives thereof, be used. Derivatives include compounds in which an amino group, acyl group, alkyl group, or similar is substituted for a portion of the hydrogen atoms forming the amino group and triazole skeleton of the 3-amino-1,2,4-triazole. Examples include:

3-amino-5-methyl-1,2,4-triazole, 3-amino-5-ethyl-1,2,4-triazole;

3-amino-5-n-propyl-1,2,4-triazole; and similar.

Among them, 3-amino-1,2,4-triazole is preferable.

One type of "aminotriazole" can be used, or two or more types can be mixed and used.

It is preferable that the mixing ratio of "aminotriazole" in the coating film (solid content) be 0.1 to 20 weight percent, and still more preferably 0.3 to 3 weight percent. By means of a value equal to or greater than the lower limit, the advantageous results of the invention can be enhanced. A value equal to or less than the upper limit is preferable with respect to solubility in the coating liquid, and moreover if addition exceeds this value, no great difference in the advantageous results tends to appear, so that a lower value is more economical.

In this specification, "coating film" means a film obtained by applying a coating liquid (application liquid), obtained by dissolving a vinyl resin and aminotriazole in a solvent, and then drying. By means of the process of coating with such a coating liquid using a solvent and then drying, a thin film of uniform thickness is obtained. Further, close adhesion between the winding body and the film is enhanced. As a result, although thin, a film with high hardness and high wear resistance is obtained.

Figure 3:
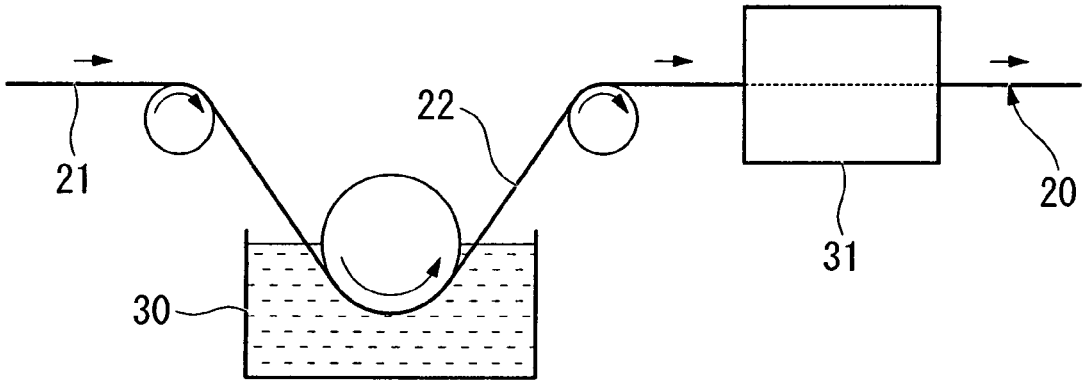
FIG. 3 is an explanatory diagram showing a portion of the processes for manufacturing a string according to the present invention.

FIG. 3 is an explanatory diagram showing a portion of the processes for manufacture of the string 1 for a musical instrument of the invention.

As shown in FIG. 3, the winding 20 can be manufactured by guiding and dipping the winding body 21 into a coating vat 30 filled with coating liquid to form a coating film 22. The winding 20 is then guided through a drying device 31 and suffers heating for example under heating conditions of 140 to 165° C. so as to cause evaporation of the solvent and drying. Upon winding and wrapping the winding 20 around the core 10, the string 1 for a musical instrument shown in FIG. 1 and FIG. 2 is obtained.

The coating liquid can for example be manufactured by dissolving a commercially marketed vinyl resin varnish and aminotriazole in an appropriate organic solvent.

Vinyl resin varnish is obtained by dissolving vinyl resin in an organic solvent; for example, products with a solid content of approximately 10 to 50 weight percent are commercially marketed. Examples of solvents for use in the vinyl resin varnish include toluene, xylene and other hydrocarbon solvents, methyl isobutyl ketone (MIBK), acetone, methyl ethyl ketone (MEK), and other ketone solvents. Among them, toluene and MIBK are preferable.

When manufacturing the coating liquid also, an organic solvent similar to that of the resin varnish can be used. When manufacturing the coating liquid, in addition to these organic solvents, if ethanol or another lower alcohol (ethanol is suitable) is used, then the solubility of the aminotriazole can be improved, which is preferable. From the standpoint of transparency of the coating liquid, it is preferable that the lower alcohol be used in the amount of approximately 25 to 100 times the weight of the aminotriazole.

The solid content concentration in the coating liquid is for example approximately 5 to 10 weight percent.

From the standpoint of achieving a satisfactory timbre, it is preferable that the thickness of the coating film 22 be 2 μm or less. From the standpoint of rust-resistant properties, in practice, the thickness is 0.5 μm or greater, and more preferably 1 μm or greater.

The string for a musical instrument and method of manufacture thereof of this invention can be applied, without any limitation in particular, to applications in any musical instrument which uses strings. For example, use in guitars, pianos, mandolins, and similar is possible.

Among these, this invention is suitable for use with instruments which are employed in performances in which a pick or similar is used to pluck strings, or the hand is brought into direct contact with the strings during a performance, as in the case of guitars and similar.

In this way, the present invention enables provision of a string for a musical instrument and a manufacturing method thereof which combine satisfactory rust-resistant properties and satisfactory timbre.

Further, the string of a musical instrument is plucked with a pick in a performance, so that the string vibrates. If the hardness or wear resistance of the coating film is inadequate, scratches may therefore occur in the coating film, and there are concerns that sweat may penetrate through such scratches to cause rusting. However, in the case of the string for a musical instrument of this embodiment, a coating film is formed which is superior with respect to both hardness and wear resistance, so that rusting caused by harsh conditions arising in the circumstances of performances, including human sweat, vibrations, plucking with a pick and similar, can be adequately prevented, and moreover a satisfactory timbre is obtained.

The reasons for obtaining such advantageous results are not clear, but it is though that by using a vinyl resin to form a coating film, a film of satisfactory strength can be formed in close adhesion to the winding body, even when the film is thin, and by this means rust-resistant properties are imparted preventing the intrusion of sweat. In addition, rust-resistant properties may be added by the aminotriazole, so that the synergetic effect of these results in superior rust-resistant properties.

Further, the coating film has high hardness and characteristics such that scratches do not easily result from plucking and similar. Because of this, even in use under harsh conditions peculiar to the strings of musical instruments, such as coming into contact with sweat, wear caused by picks and similar, and vibrations, the string can exhibit stable rust-resistant properties, and is inferred to result in a satisfactory timbre.

Further, because a coating film comprising a vinyl resin has satisfactory sliding properties, the string affords excellent performance properties. Moreover, unpleasant noises are also reduced.

In the string of this embodiment, a coating film is formed on a winding body, and so in contrast with cases in which a winding body is wound around a core and a polymer cover or other film is provided on the entirety of the string body, excess resin film is not formed between adjacent windings of the winding body or between the core and the winding, and so a satisfactory timbre is obtained.

Below, embodiments are used to explain the invention in greater detail; however, the invention is not limited to these embodiments.

[Manufacture of Samples (Strings for Musical Instruments) for Rust-Resistant Property Tests and Timbre Tests]

Strings were manufactured as described below. As the core, steel wire with a hexagonal cross-section (diameter 0.42 mm) was used. As the winding body, brass wire with a circular cross-section (diameter 0.47 mm) was used.

EMBODIMENT

A vinyl resin varnish was prepared, consisting of a vinyl resin, comprising 86 weight percent vinyl chloride monomer unit, 13 weight percent vinyl acetate monomer unit, and 1 weight percent maleic acid monomer unit, dissolved in toluene, with a solid content concentration of 40 weight percent.

To this vinyl resin varnish various solvents with the compositions shown in Table 1, and 3-amino-1H-1,2,4-triazole were added and mixed, to manufacture the coating liquid.

This coating liquid was applied to the winding body, and was dried at 150° C. to cause evaporation of the solvent, forming a coating film of thickness 1.5 μm.

This winding was then wound onto a core to obtain a string for a musical instrument.

COMPARATIVE EXAMPLE 1

A solution in which 0.5 g of benzotriazole and 100 g of industrial ethyl alcohol are mixed was applied to the surface of a winding body and was dried to manufacture the winding; in other respects, the string for a musical instrument was obtained in a manner similar to the above Embodiment.

COMPARATIVE EXAMPLE 2

As indicated in Table 1, apart from using a coating liquid which does not include the 3-amino-1H-1,2,4-triazole, the string for a musical instrument was manufactured similarly to the above Embodiment.

TABLE 1

| | Embodiment | Comparative Example 2 |
|---|---|---|
| Vinyl resin varnish (vinyl resin concentration: approx. 20 weight percent; solvent: toluene) | 400.0 g (vinyl resin approx. 80.0 g) | 400.0 g (vinyl resin approx. 80.0 g) |
| MIBK | 230.0 g | 240.0 g |
| Toluene | 345.0 g | 360.0 g |
| Ethanol | 25.0 g | 0.0 g |
| 3-amino-1H-1,2,4-triazole | 1.0 g | 0.0 g |

COMPARATIVE EXAMPLE 3

First a winding body was wound onto a core to manufacture the string body, and then, similarly to the Embodiment, this was immersed in coating liquid, drying was performed under conditions similar to the above Embodiment, and a coating film was formed over the entirety of the side face of the string body, to obtain a string for a musical instrument.

[Evaluation Method]

The evaluation method and evaluation criteria were as follows.

<Rust-Resistant Properties Test Using Artificial Human Sweat>

A rust-resistant properties test was carried out. The rust-resistant properties test includes the steps of: preparing artificial sweat which includes sodium chloride; coating the strings of the embodiment, and comparative examples 1 to 3 with the artificial sweat; leaving the strings coated with the artificial sweat in a thermo-hygrostatic chamber; and, after that, observing exterior of the strings.

Evaluations of the rust-resistant properties test were performed using the following criteria. The results are indicated in Table 2 shown in later, in the "Rust-resistant properties test" column, using the following symbols.

O: No change in color

A: Partial blackening

X: Overall blackening

<Timbre Tests>

Strings for musical instruments were used in short-time Fourier transform (STFT) analysis as the testing method, to measure the relation between time and attenuation of the harmonic components. The same guitar instrument was used to perform measurements under the same conditions. As strings, sixth ($6^{th}$ or E) wound strings, from which tone differences are easily obtained, were used.

The 11th harmonic, 912 Hz, is the frequency of the 11th harmonic of the E note of the six strings (fundamental tone, approximately 80 Hz).

The 25th harmonic, 2032 Hz, is the frequency of the 25th harmonic of the E note of the six strings (fundamental tone, approximately 80 Hz).

Figure 4:
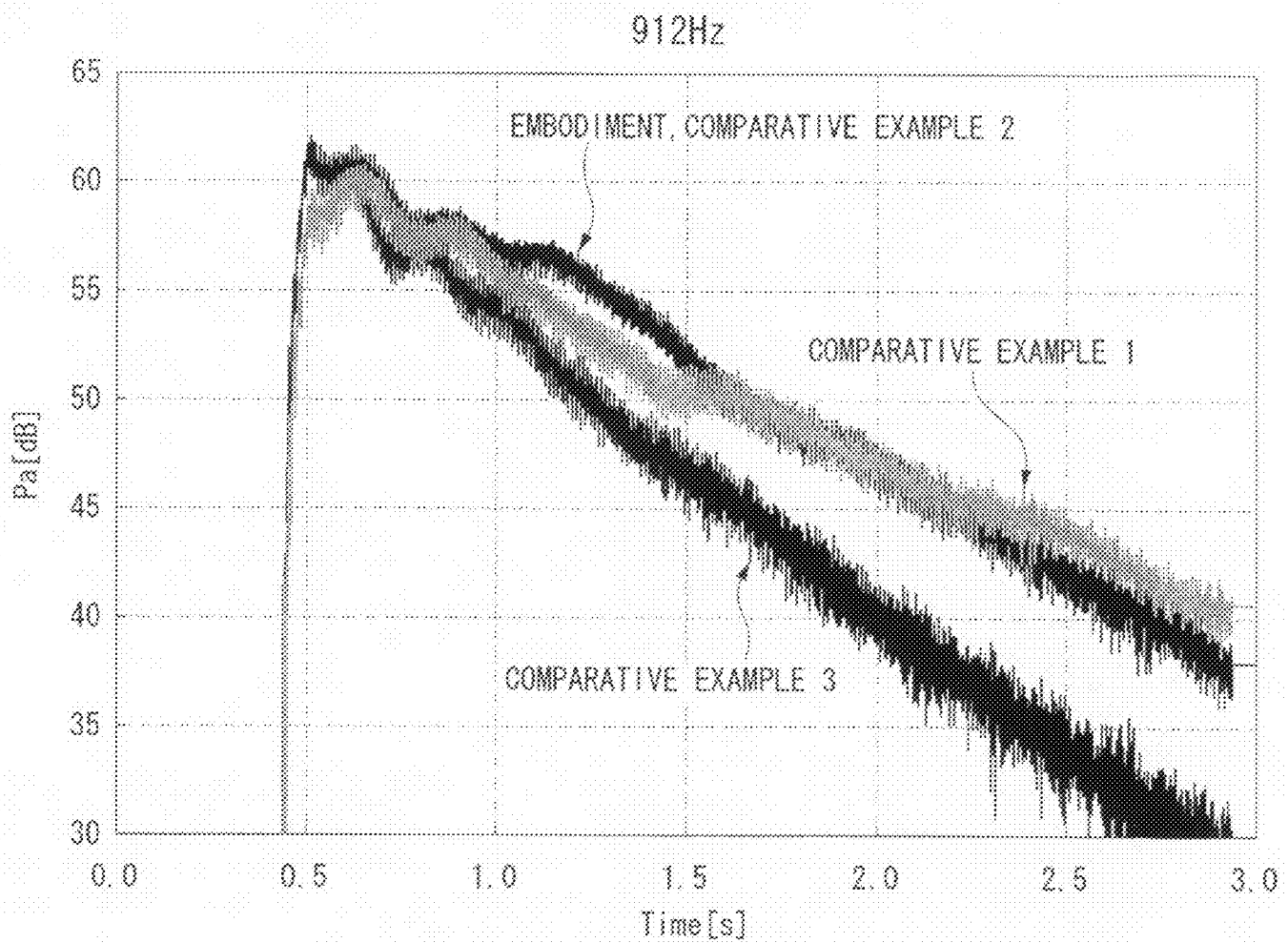
FIG. 4 is a graph showing the result of timbre tests at the 11th harmonic (912 Hz).
Figure 5:
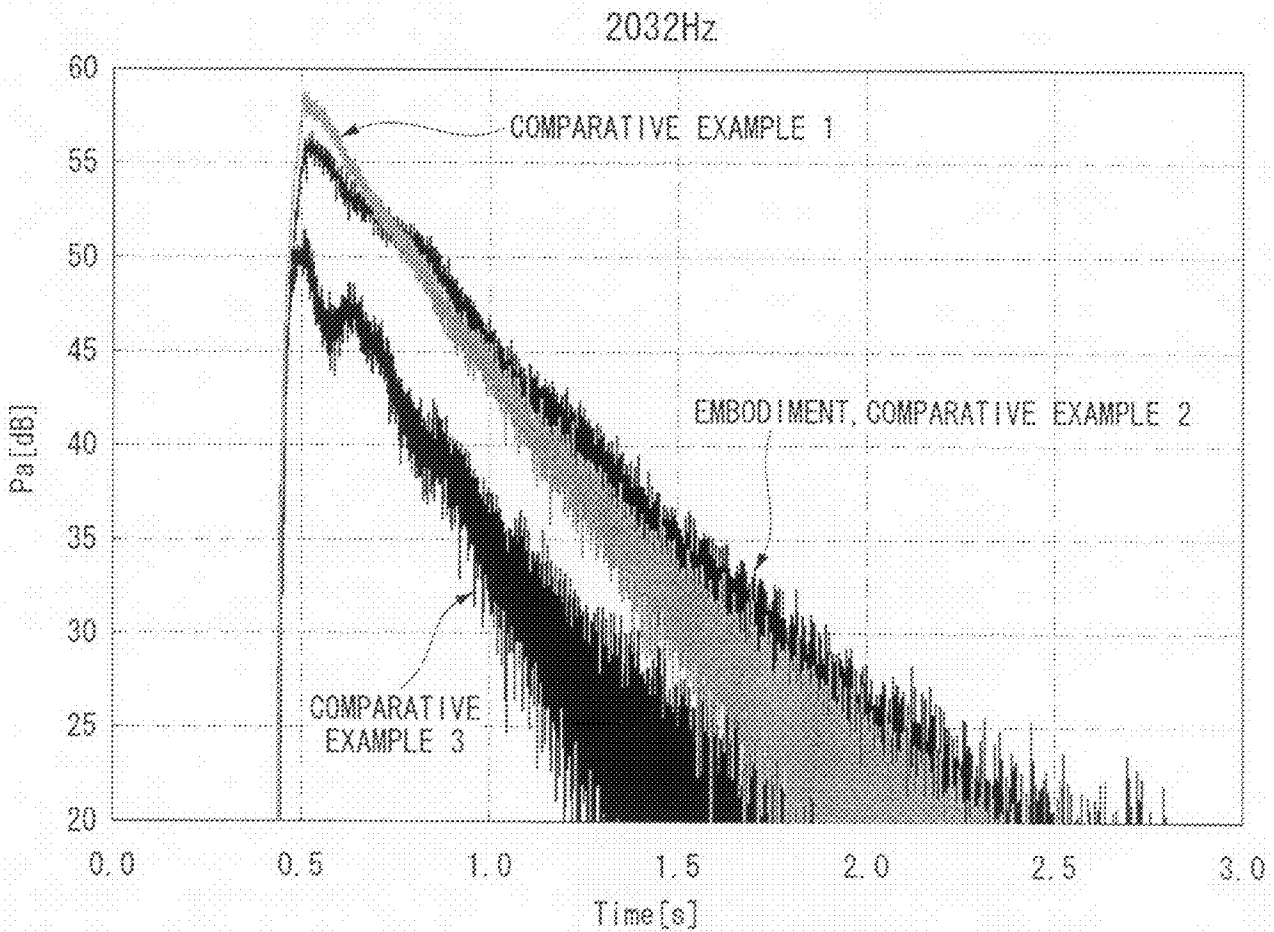
FIG. 5 is a graph showing the result of timbre tests at the 25th harmonic (2032 Hz).

The results of timbre tests for the 11th harmonic and for the 25th harmonic are shown in the graphs of FIG. 4 and FIG. 5, respectively.

The following criteria were used in evaluations; the results appear in the "Timbre tests" column of Table 2, using the following symbols.

G: Sound pressure is high at the leading edge of harmonics, attenuation is small as time passes, and perceived evaluation is good N: Sound pressure is low at the leading edge of harmonics, attenuation is large as time passes, and perceived evaluation is poor, or seems unnatural The Embodiment of this invention was confirmed to yield a high sound pressure at the leading edge of the sound, with low attenuation as time passes, resulting in a satisfactory timbre, not inferior to that of Comparative Example 1.

On the other hand, because in Comparative Example 3 a coating film was provided on the entire string body, the sound pressure of sound was low at the leading edge of the harmonic components, attenuation with the passing of time was also large. Its timbre was, therefore, confirmed to be extremely poor compared with Comparative Example 1 and the Embodiment.

TABLE 2

| | Rust-resistant properties | Timbre tests |
|---|---|---|
| Embodiment | O | G |
| Comparative Example 1 | X | G |
| Comparative Example 2 | A | G |
| Comparative Example 3 | — | N |

From the results shown in Table 2 and in FIG. 4 and FIG. 5, a string for a musical instrument of this invention was confirmed to have excellent rust-resistant properties and a satisfactory timbre.

While the preferred embodiment of the invention has been described and illustrated above, it should be understood that it is exemplary of the invention and is not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A string for a musical instrument used to be directly contacted by a human hand, consisting of:

a single core; and, a winding wound around the single core, the winding having a winding body and a coating film formed on said winding body, the coating film consisting of a mixture of vinyl resin and aminotriazole, whereby rusting of the string is inhibited.

2. The string for a musical instrument according to claim 1, wherein said vinyl resin has a vinyl chloride monomer unit and a vinyl acetate monomer unit.

3. The string for a musical instrument according to claim 2, wherein said vinyl resin further has a maleic acid monomer unit.

4. The string for a musical instrument according to claim 1, wherein the thickness of said coating film is 2 μm or less.

5. The string for a musical instrument according to claim 1, wherein said winding body is formed from copper or an alloy comprising copper.

6. A method for manufacturing a string for a musical instrument used to be directly contacted by a human hand, consisting of the ordered steps of:

applying a coating liquid consisting of vinyl resin and aminotriazole, to a winding body;

drying said coating liquid to form a coating film so as to form a winding; and wrapping said winding around a single core, whereby rusting of the string is inhibited.

7. The string for a musical instrument according to claim 1, wherein said coating film consists of 0.1 to 20 wt % aminotriazole and at least 80 wt % vinyl resin.

8. The string for a musical instrument according to claim 7, wherein said aminotriazole is 0.3 to 3 wt % and said at least vinyl resin is at least 97 wt %.

* * * * *